US006024465A

United States Patent [19]

Kobayashi

[11] Patent Number: 6,024,465

[45] Date of Patent: Feb. 15, 2000

[54] LIGHTING FIXTURE

[75] Inventor: Masato Kobayashi, Kanagawa-ken, Japan

[73] Assignee: Toshiba Lighting & Technology Corporation, Tokyo, Japan

[21] Appl. No.: 09/182,652

[22] Filed: Oct. 30, 1998

[30] Foreign Application Priority Data

Oct. 31, 1997 [JP] Japan ..... 9-299893
Dec. 26, 1997 [JP] Japan ..... 9-361185

[51] Int. Cl.[7] ..... F21S 3/00; F21V 29/00

[52] U.S. Cl. ..... 362/218; 362/264

[58] Field of Search ..... 362/218, 260, 362/264, 294, 373, 427

[56] References Cited

U.S. PATENT DOCUMENTS 5,161,884 11/1992 Sminovitch ..... 362/294

*Primary Examiner*—Jon Henry
*Attorney, Agent, or Firm*—Pillsbury Madison & Sutro LLP

[57] ABSTRACT

A lighting fixture including a fluorescent lamp and a heat conductive member. One end of the heat conductive member contacts the fluorescent lamp and extends outside of the lighting fixture through a through hole. The cool spot of the fluorescent lamp can thus be efficiently cooled irrespective of the temperatures inside the main part of the lighting fixture.

8 Claims, 4 Drawing Sheets

LIGHTING FIXTURE

BACKGROUND OF THE INVENTION

1. Field of the Invention

The present invention relates to a lighting fixture having a fluorescent lamp and a heat conductive member for cooling the fluorescent lamp.

2. Description of the Related Art

Today, several lighting fixtures including a low-pressure mercury vapor discharge fluorescent lamp are available for producing light. The fluorescent lamp shows improved luminous flux if the temperature of the fluorescent lamp is controlled. In particular, the cool spot of the surface of an air tight or hermetic vessel of the fluorescent lamp should achieve a predetermined temperature. A vent hole in the main part of the lighting fixture helps to control the temperature of the fluorescent lamp is well known. The known vent holes may not, however, provide adequate cooling. For example, a lighting fixture for recessed mounting in a ceiling has an undersurface cover. The underside cover may raise the temperature in the main part of the lighting fixture, because the underside cover reflects light and heat. If the temperature of the cool spot of the fluorescent lamp may thus exceed the optimum temperature, and the luminous flux deteriorates.

Japanese Utility Model Laid Open No. 1-68610 discloses a fluorescent lamp having a U shaped transparent hermetic vessel and a lamp base mounted one end of the vessel. The tip portion of the fluorescent lamp projects beyond a reflective board in the inner side of the main part of the lighting fixture. The top portion of the lighting fixture has a vent hole, and heat reflected from the reflective board can radiate around the tip of the fluorescent lamp and out the vent hole.

In the device of Japanese Utility Model Laid Open No. 1-68610, the vessel of the fluorescent lamp tends to receive damage from the hole in the reflective board. Moreover, the portion of the fluorescent lamp located outside the reflective board does not contribute to luminescence.

Japanese Patent Laid Open No. 5-225819 also discloses a fluorescent lamp having a U shaped transparent hermetic vessel and a lamp base mounted one end of the vessel. In the inner side of the main part of the lighting fixture, metallic supports hold the tip portion of the fluorescent lamp, and the composition of the supports allows the main part of the lighting fixture to conduct heat generated by the fluorescent lamp.

Japanese Patent Laid Open No. 4-303510 discloses a thin type of lighting fixture. In this type of lamp, the inside diameter of the fluorescent lamp is thin. The fluorescent lamp is operating by a high frequency lighting circuit. The fluorescent lamp has the inside diameter 23–26 mm and is attached in the lighting fixture. This fluorescent lamp is referred to as a T8 type so called a compact lamp. The lighting fixture has a means to conduct heat because the ends of the fluorescent lamp are thermally connected to the reflector. Furthermore, a vent hole, in a position corresponding to the end of the transparent hermetic vessel at the ceiling side of the lighting fixture, allows heat from the fluorescent lamp conducted by the reflector to radiate. Compared with a lamp having large diameter, the surface temperature of T8 type tends to become high. Because heat cannot escape from the main part of the lighting fixture, the surface temperature of the hermetic vessel rises. The mercury pressure in the fluorescent lamp thus becomes too high and self-absorption of light by the mercury increases. The fluorescent lamp brightness thus deteriorates compared with the highest value, and the luminous efficacy decreases. Furthermore, because the wall load on the transparent hermetic vessel increases when the diameter of the inner transparent hermetic vessel is made small like T5 type so called the compact lamp, the temperature of the transparent hermetic vessel becomes even higher.

The fluorescent lamp is connected to the reflector to conduct heat in Japanese Patent Laid Open No. 5-225829 and Japanese Patent Laid Open No. 4-303510. However, when the reflector becomes hot, the cool spot of the fluorescent lamp is not cooled effectively.

The wall load in a fluorescent lamp of T5 type or T8 type is relatively large. The compact lamp has a high lamp surface temperature, compared with the fluorescent lamp of so called T10 type, so heat of the compact lamp cannot effectively escape from the main part of the lighting fixture. The mercury pressure thus becomes too high and self-absorption of light by the mercury increases.

Because the wall load of the fluorescent lamp increases when the diameter of the transparent hermetic vessel is made small like T5 type, the temperature of the transparent hermetic vessel becomes increasingly high. Then leak current becomes a problem in achieving high frequency lighting of the fluorescent lamp. The fluorescent lamp with a thin diameter like the T5 type has a high rate of leak current compared with a fluorescent lamp with a thick diameter and the same consumption of electric power. The reason is that the part to which the fluorescent lamp voltage went up, and lamp current decrease since the diameter is thin. Therefore, when the lighting fixture has a means are thermally connected to the fluorescent lamp, leak current must be considered.

SUMMARY OF THE INVENTION

An object of the present invention is to provide a low-pressure mercury vapor discharge fluorescent lamp for high frequency lighting. Another object of the present invention is to provide a fixture, which having heat conductive member cools the fluorescent lamp effectively.

In accordance with an embodiment of the invention, a lighting fixture for illuminating a room includes a lamp housing which having a through hole; a lamp mounted in the lamp housing, the fluorescent lamp having a transparent hermetic vessel, a discharge medium including mercury sealed in the vessel, a pair of electrodes fixed to the vessel, a discharge path in the vessel, and a bend portion in the middle of the discharge path; and a heat conductive member mounted in the lamp housing, the heat conductive member having a thermal conductivity portion in thermal contact with an external surface of the fluorescent lamp near the bend portion and a heat dissipating portion located near the through hole of the lamp housing. This embodiment, including the through hole and the heat conductive member, allows the fluorescent lamp to maintain a good working temperature.

In one embodiment, because the tip side of the fluorescent lamp combines with the fluorescent lamp contact portion thermally, loss of light in the optical radiation direction becomes small.

Furthermore, the lighting fixture of an embodiment has a lamp contact portion with high thermal conductivity using a rubber with high electrical insulation. With this composition, the fluorescent lamp contact portion contacts and holds the fluorescent lamp, and heat conducts through the heat conductive member from the fluorescent lamp efficiently.

Because the fluorescent lamp contact portion electrically insulates, it can stop leak current from the fluorescent lamp during operating.

Furthermore, the lighting fixture of one embodiment has a socket only at one end of the transparent hermetic vessel. The heat conductive member and the fluorescent lamp socket are at opposite ends of the fluorescent lamp. The fluorescent lamp is thus stabilized and supported between the fluorescent lamp socket and the heat conductive member. The heat conductive member may move or rotate when the fluorescent lamp detaches. When the heat conductive member moves, the attachment and detachment of the fluorescent lamp becomes easy.

Furthermore, the lighting fixture of the present invention may include an optical control means which covers the direction compared with the main part of the lighting fixture. Although the aperture portion of the main part of the lighting fixture is covered by the optical control means and the temperature of the main part inner side of the lighting fixture becomes easy to rise, the cool spot of the fluorescent lamp is efficiently cooled by the heat conductive member.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DESCRIPTION OF THE PREFERRED EMBODIMENT

According to the present invention, a lighting fixture includes a low pressure mercury vapor discharge fluorescent lamp. A heat conductive member contacts and supports the fluorescent lamp in the lighting fixture. The heat conductive member conducts heat from the fluorescent lamp to a vent hole in the lighting fixture. If the fluorescent lamp has a U shape, the heat conductive member may be located at the bend portion.

Figure 1:
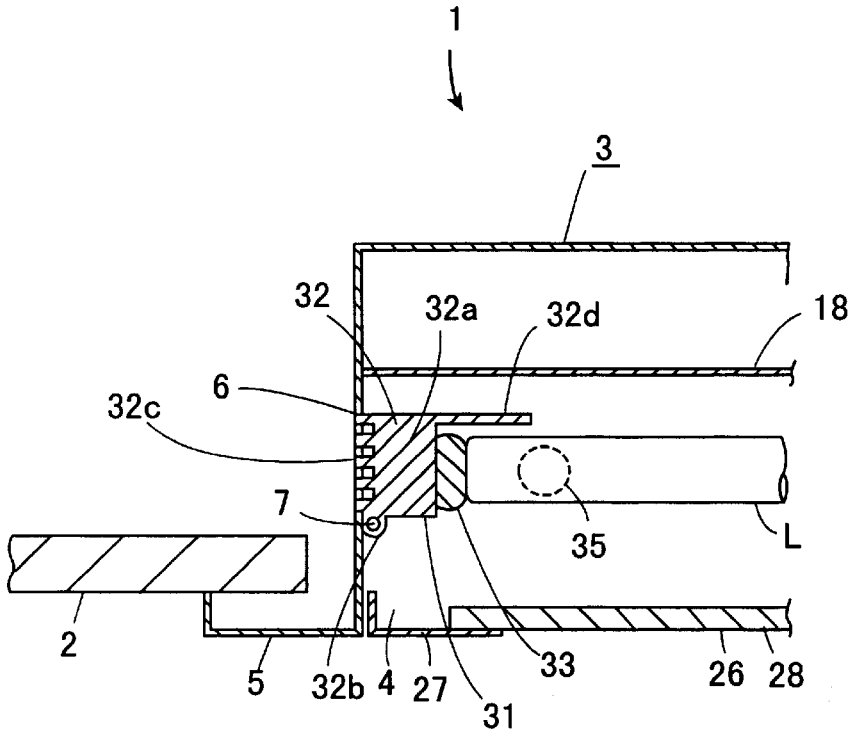
FIG. 1 is a partial sectional view of a fist embodiment of a lighting fixture of the present invention.
Figure 2:
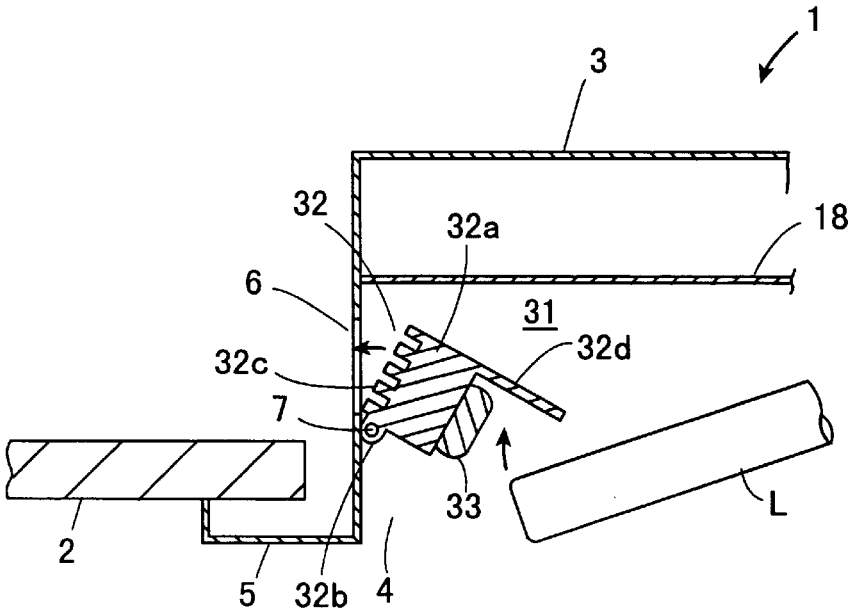
FIG. 2 is a partial sectional view showing the attachment of a fluorescent lamp in the lighting fixture shown in FIG. 1.
Figure 3:
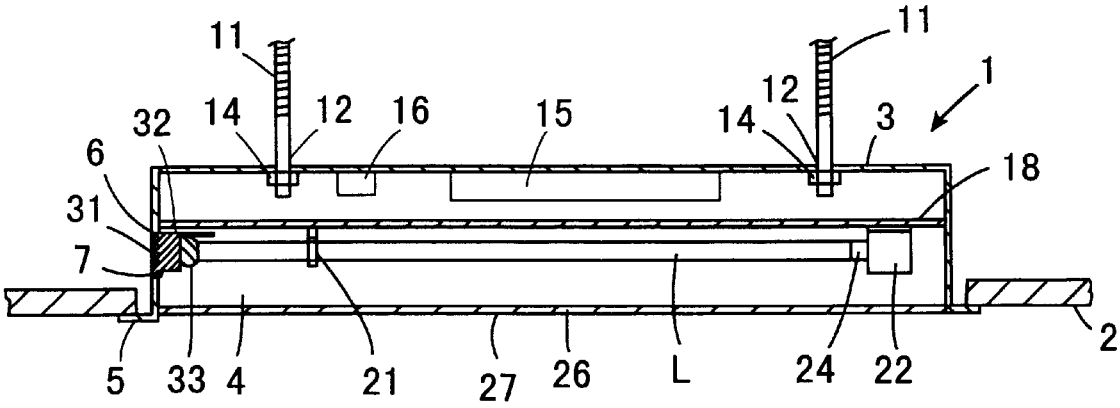
FIG. 3 is a sectional view of the lighting fixture of the first embodiment.
Figure 4:
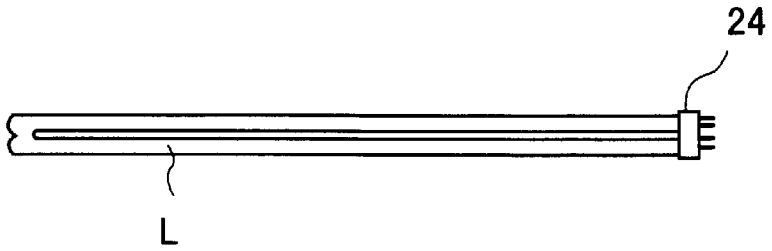
FIG. 4 shows a plane view of a fluorescent lamp according to the first embodiment.

FIGS. 1, 2, and 3 show a lighting fixture 1, which is for recessed mounting in a ceiling, according to a first embodiment of the invention. The lighting fixture 1 has an air tight or hermetic fluorescent lamp that contains mercury. The ends of the fluorescent lamp may terminate at lamp bases 24 or a single lamp base 24. When the light is turned on, the fluorescent lamp generates light. FIG. 4 shows a preferred embodiment of the fluorescent lamp.

A main part 3 of the lighting fixture 1 attaches to a surface of the ceiling board 2. The ceiling board 2 has an aperture to receive the lighting fixture 1. The main part 3 of the lighting fixture 1 has a box shape with an undersurface aperture 4 for illumination. A flange portion 5 around the perimeter of the aperture 4 thermally connects the lighting fixture 1 to the undersurface of the ceiling board 2. A side wall of the main part 3 includes a rectangular through hole 6. A bearing 7 is also formed in the side of the main part 3 near the through hole 6.

Bolts 11 may attach to a beam in the inside space of the ceiling or upper floor braces to secure or hang the lighting fixture 1. The bolts 11 then penetrate small holes 12 in the upper surface of the main part 3, and nuts 14 secure the main part 3 of the lighting fixture to a tip portion of each bolt 11.

An inverter circuit housing 15 and a terminal stand 16 are attached to an underside of the top surface of the main part 3. The main part 3 also supports a reflector 18 between that underside and the fluorescent lamp. A lamp holder 21 is attached to the undersurface of the reflector 18 toward the through hole 6. A lamp socket 22 is attached to the reflector away from the through hole 6. The fluorescent lamp socket 22 connects to a lamp base 24. The fluorescent lamp holder 21 supports the fluorescent lamp L near a tip portion of the fluorescent lamp. The fluorescent lamp L has a lamp base only at one end of the transparent hermetic vessel. The vessel is an elongated tube has inside diameter of greater than 15 mm but less than 26 mm.

The aperture 4, located underneath the fluorescent lamp L, allows light to exit the lighting fixture 1 and is covered by a preferably translucent optical control sheet 28. A frame 27 supports the optical control sheet 28.

A heat conductive member 31 is inside an end side of the main part 3 of the lighting fixture. The heat conductive member includes a heat dissipation object 32 that preferably includes structure such as aluminum heat dissipation fins 32C. The heat dissipation object 32 has a block like base portion 32*a*. An axial branch 32*b* extends from one end of the base portion 32*a*. The bearing 7 supports the axial branch 32*b*. A board like elongated portion 32*d* extends from an edge of the base portion 32*a*.

A lamp contact portion 33 is attached to the heat dissipation object 32. The fluorescent lamp contact portion 33 is attached to one edge of the base portion 32*a* by adhesion or some other means. The fluorescent lamp contact portion 33 has a high thermal conductivity. The fluorescent lamp contact portion 33 is preferably formed of an elastic material including high thermal conductivity elements, such as a silicone rubber including fiberglass. The fluorescent lamp contact portion 33 is also with high electric insulation. The fluorescent lamp contact portion 33 and the elongated portion 32*d* are preferably on the same side of the base portion 32*a*. The axial branch 32*b* is preferably on the other side of the base portion 32*a*. Thus, the elongated portion 32*d* helps define the position of the fluorescent lamp.

The heat conductive member 31 pivots on the bearing 7 to allow attachment and detachment of the fluorescent lamp L as shown in FIG. 2.

The heat conductive member 31 positions the fluorescent lamp contact portion 33 near the tip portion 35 of the fluorescent lamp L. The tip portion near the fluorescent lamp socket 21 is the cool spot of the fluorescent lamp. The heat conductive member 31 transmits heat from the cool spot directly to the exterior of the main part 3 of the lighting fixture through the through hole 6. The cool spot of the fluorescent lamp L is thus cooled efficiently, and the luminous flux of the fluorescent lamp L improves. Moreover, the fluorescent lamp contact portion 33 thermally combined with the fluorescent lamp L has a high thermal conductivity. The fluorescent lamp contact portion 33 is preferably made of silicone rubber with high electric insulation. Therefore, the fluorescent lamp contact portion 33 can be stuck to the fluorescent lamp, and the heat conductive member 31 can conduct heat from the fluorescent lamp L efficiently.

The fluorescent lamp L has a lamp base 24 and a lamp socket 22 only at one end of the transparent hermetic vessel, and the heat conductive member 31 is at the other end. Therefore, the fluorescent lamp socket 22 and the heat conductive member 31 stabilize and support opposite sides of the fluorescent lamp L.

Furthermore, the tip side of lamp L combines with the fluorescent lamp contact portion 33 thermally. Therefore, light loss can be made small.

Moreover, the heat conductive member 31 rotates for easy attachment and detachment of the fluorescent lamp L. The elongated portion 32*d* guides fluorescent lamp L into the mounted position as the heat conductive member 31 rotates into the mounted position.

Because the optical control means 28 covers the aperture 4 which the main part 3 of the lighting fixture illuminates, lighting effect can be improved. In the past, if the optical control means 28 covers the aperture 4, the internal temperature of the main part 3 of the lighting fixture will become too hot. However, the heat conductive member 31 cools the cool spot 35 of fluorescent lamp L and the luminous flux improves.

Figure 5:
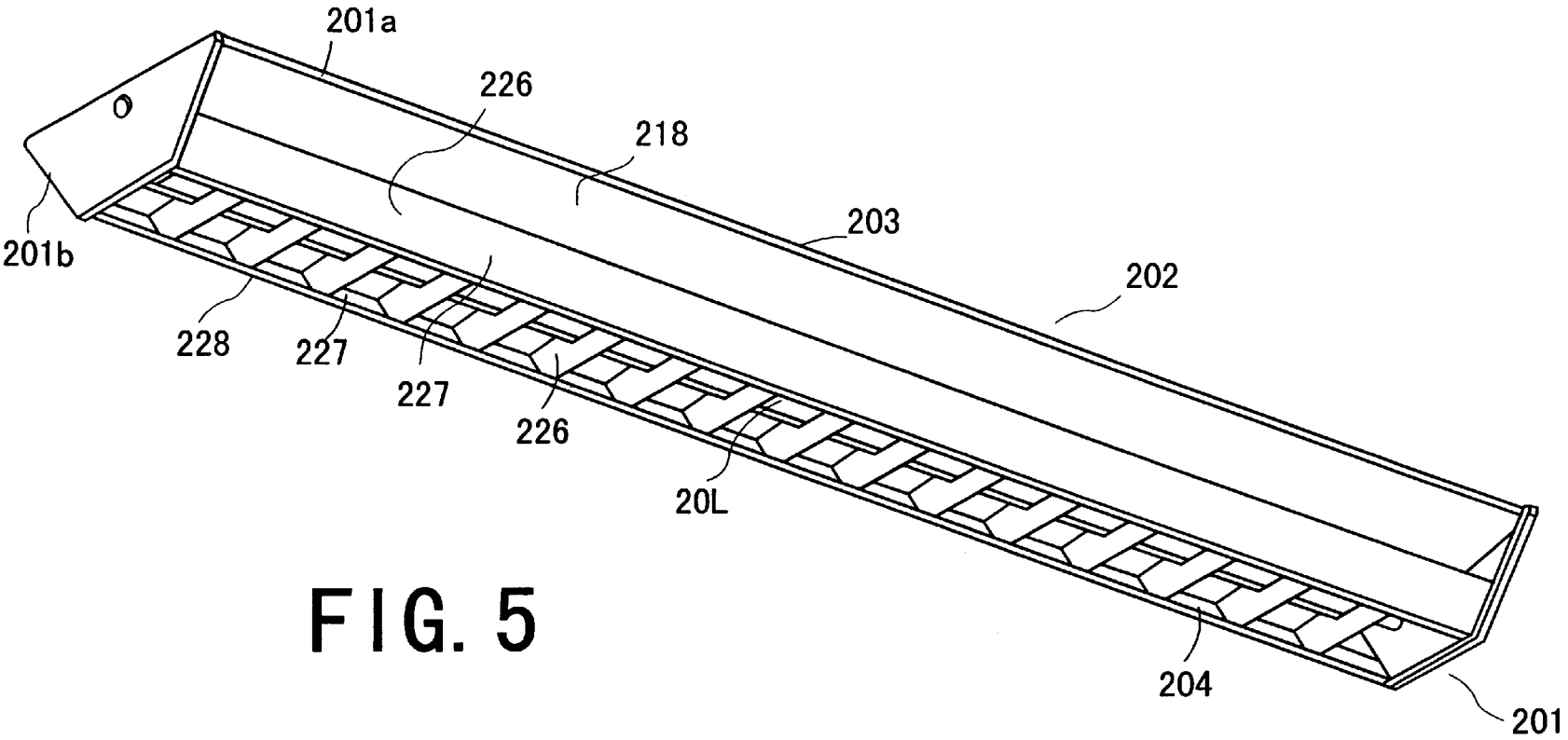
FIG. 5 is a perspective bottom view of a second embodiment of a lighting fixture of the present invention.
Figure 6:
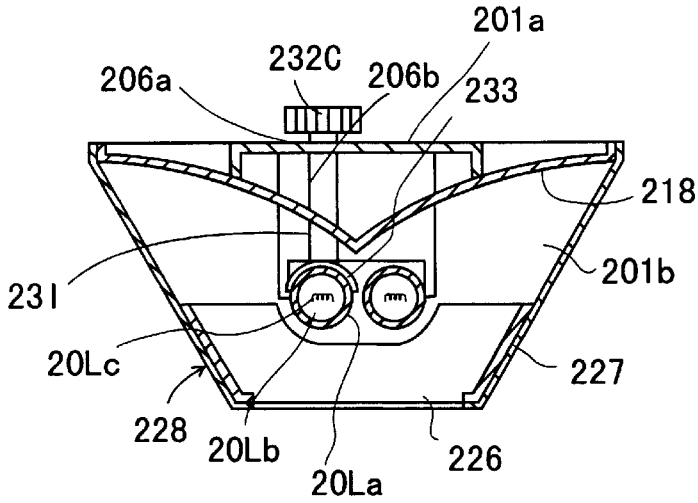
FIG. 6 is a sectional view of view in the lighting fixture shown in FIG. 5.
Figure 7:
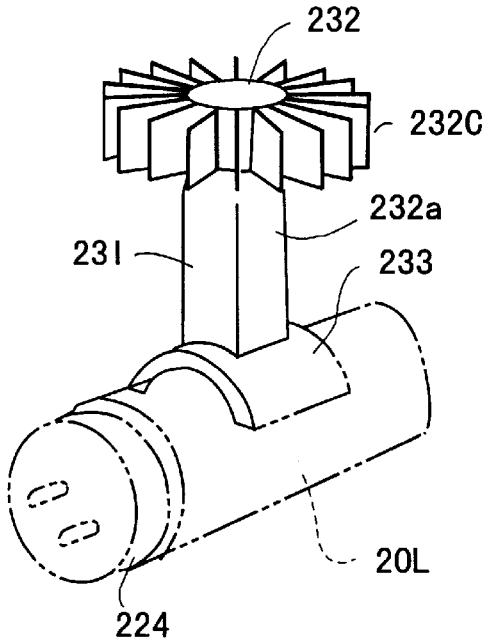
FIG. 7 is a perspective top of view of the principal part of the second embodiment.

FIGS. 5,6, and 7 show a lighting fixture, which is for surface-mounted type, according to a second embodiment of the invention. A main part 203 of the lighting fixture attaches to a surface of the ceiling board 202. The ceiling board 202 has an aperture to receive the lighting fixture. The main part 203 of the lighting fixture 201 has a box shape with an undersurface aperture 204 for illumination. A flange portion 205 around the perimeter of the aperture 204 thermally connects the lighting fixture to the undersurface of the ceiling board 202. The main part 203 having a top wall 201*a* and a pair of side wall 201*b*. The top wall 201*a* includes a rectangular through hole 206*a*. A rectangular through hole 206*b* is also formed in the reflector 218 near the through hole 206*a*.

A reflector 218 is attached to an underside of the top wall 201*a* of the main part 203. The main part 3 also supports a reflector 218 between that underside and a pair of the straight shaped fluorescent lamps 20L. The fluorescent lamp 20L has a pair of lamp base 224 at one end of the transparent hermetic vessel 20L*a*. The vessel 20L*a* is a straight elongated tube, has inside phosphor layer 20L*b* and a pair of electrode 20L*c*, 20L*c*.

The aperture204, located underneath the fluorescent lamp 20L, allows light to exit the lighting fixture and is covered by a preferably optical control element 228. The optical control element 228 having a pair of frame 227 and plenty of louvre 226. The frame 227, which is cutting for glaring, supports the optical control element 228.

A heat conductive member 231 is inside an end side of the main part 203 of the lighting fixture. The heat conductive member 231 includes a heat dissipation object 232 that preferably includes structure such as aluminum heat dissipation fins 232C. The heat dissipation object 232 has a block like base portion 232*a*.

A lamp contact portion 233 is attached to the heat dissipation object 232. The fluorescent lamp contact portion 233 is attached to one edge of the base portion 232*a* by adhesion or some other means. The fluorescent lamp contact portion 233 is formed of the same material as the contact portion 33. The heat conductive member 231 transmits heat from the cool spot directly to the exterior of the main part 3 of the lighting fixture through the through hole 206*a*, 206*b*.

Numerous modifications and variations of the present invention are possible in light of the teachings. It is therefore to the understood that, within the scope of the appended claims, the present invention can be practiced in the manner other than as specifically described herein.

What is claimed is:

1. A lighting fixture, comprising:

a lamp housing having a through hole and an aperture for emitting light;

a fluorescent lamp mounted in the lamp housing, the fluorescent lamp having a transparent hermetic vessel, a discharge medium including mercury sealed in the vessel, a pair of electrodes fixed to the vessel, a discharge path in the vessel, and a bend portion in the discharge path; and a heat conductive member mounted in the lamp housing, the heat conductive member having a thermal conductivity portion in thermal contact with an external surface of the fluorescent lamp near the bend portion and a heat dissipating portion located near the through hole of the lamp housing.

2. A lighting fixture according to claim 1, wherein the thermal conductivity portion has an electrically insulating property.

3. A lighting fixture according to claim 1, wherein the thermal conductivity portion has an elastic property.

4. A lighting fixture, comprising:

a lamp housing having at least one through hole and an aperture for emitting light;

a fluorescent lamp supported within the lamp housing and arranged to emit light through the aperture; and a heat conductive member in thermal contact with the fluorescent lamp and in thermal contact with the lamp housing near the through hole, the heat conductive member being arranged to conduct heat from the fluorescent lamp to the through hole and outside of the lamp housing.

5. A lighting fixture according to claim 4, wherein the fluorescent lamp comprises an elongated tube has inside diameter of greater than 15 mm but less than 26 mm.

6. A lighting fixture according to claim 5, wherein the tube includes a bend portion, and wherein the heat conductive member is in thermal contact with the fluorescent lamp at the bend portion.

7. A lighting fixture according to claim 6, further comprising a thermal contact connecting the bend portion to the heat conductive member, the thermal contact being a heat conductor and an electrical insulator.

8. A lighting fixture according to claim 4, further comprising a thermal contact connecting the fluorescent lamp to the heat conductive member, the thermal contact being a heat conductor and an electrical insulator.

* * * * *